United States Patent [19]

Schouten

[11] 4,162,009

[45] Jul. 24, 1979

[54] MEANS AND METHOD FOR PACKAGING ENDLESS FABRICS

[75] Inventor: Peter Schouten, Grovedale, Australia

[73] Assignee: Huyck Corporation, Wake Forest, N.C.

[21] Appl. No.: 894,995

[22] Filed: Apr. 10, 1978

[51] Int. Cl.[2] ..... B65D 85/02; B65D 85/672

[52] U.S. Cl. ..... 206/389; 206/522; 242/1; 242/85

[58] Field of Search ..... 206/389, 410, 409, 393, 206/522, 303; 242/85, 1, 34

[56] References Cited

U.S. PATENT DOCUMENTS

| | | | |
|---|---|---|---|
| 2,340,269 | 1/1944 | Hoover | 242/85 |
| 2,868,369 | 1/1959 | Webb | 242/1 |
| 3,142,599 | 7/1964 | Chavannes | 206/522 |
| 3,186,543 | 1/1965 | Minick et al. | 206/393 |
| 3,389,534 | 6/1968 | Pendleton | 206/522 |
| 3,942,637 | 3/1976 | Glennie | 206/410 |
| 4,034,926 | 7/1977 | Wegner | 206/409 |

*Primary Examiner*—William T. Dixson, Jr.
*Attorney, Agent, or Firm*—Melville, Strasser, Foster & Hoffman

[57] ABSTRACT

A package for endless fabrics, such as forming fabrics used on papermaking machines, the package comprising a pair of inner cores inserted in an elongated endless fabric at its opposite extremities, one of the inner cores being surrounded by an outer core having a longitudinal slot through which the fabric projects, the outer core preferably being of split and hinged construction. The projecting portion of the fabric is wound around the outer core with the other of the inner cores juxtaposed to the rolled fabric and the cores secured together to form the package. The outer core is preferably encapsulated in cushioning material and the edges of the outer core defining the longitudinal slot through which the fabric projects may be enlarged to increase the wrap angle of the fabric, the package acting to prevent creasing of the fabric as it is packaged for shipment and storage.

10 Claims, 5 Drawing Figures

MEANS AND METHOD FOR PACKAGING ENDLESS FABRICS

This invention relates to the packaging of endless fabrics, and while its utility is not limited to any particular type of endless fabric, it will find particular utility in connection with the packaging of fabrics used in the papermaking industry.

BACKGROUND OF THE INVENTION

In the manufacture of paper on a Fourdrinier papermaking machine, the furnish or slurry of fibers is deposited on a traveling endless belt or wire which passes around a set of rolls. In recent years, the papermaking belts, known generally as forming fabrics, have been formed from a length of fabric which is either woven endless or woven flat with its ends seamed together to form an endless belt. The size of the forming fabrics will vary with the size of the papermaking machine, but it is not uncommon to provide forming fabrics having a circumferential length of 200 or more feet and a width of up to 30 or more feet. Once the fabrics have been manufactured, they must be packaged for shipment and storage, which has presented numerous problems, particularly since it is imperative to prevent the fabric from being creased since creases can adversely affect the performance of the fabric on the papermaking machine. Creases tend to wear more rapidly and also mark the sheet of paper being produced.

The current technique for packing and storing forming fabrics comprises the rolling of the fabric on poles or cores formed from paper or fiberboard, plastic or metal. FIGS. 1 and 2 of the drawings illustrate the standard technique utilized to roll forming fabrics for shipment and storage. As seen in FIG. 1, the cores 1 and 3 are inserted at each end inside the fabric loop, the core 2 being placed on the outside of the fabric loop adjacent the core 1. The fabric is then rolled about the two cores 1 and 2, whereupon the core 3 is positioned to form a triangular configuration, the rolled fabric being shown in FIG. 2.

While the type of packaging just described has been widely used in the industry, it nonetheless has presented a number of problems. For example, to obtain the desired triangular configuration, it is often necessary to space apart the cores 1 and 2 on which the fabric is rolled by means of spacers at each end of the cores. Such spacing at the end of the cores leads to the cores bowing toward each other at their centers. Such bowing results in creases in the fabric due to the fact that the fabric will be slack in the center and hence will crease unless extreme care is taken by the persons rolling the fabric. In addition, in order to obtain the desired triangular configuration, it may be necessary to roll the fabric several times before the proper distance is established between the cores 1 and 2 so that core 3 may be seated between them. The more a fabric is handled, the greater become the chances of inducing creases.

In accordance with the present invention, both of the aforementioned causes of creases in fabrics are eliminated, the first by eliminating the non-parallel double core, and the second by eliminating the need for a triangular package.

SUMMARY OF THE INVENTION

In accordance with the present invention, two cores of standard construction are inserted by each end inside the fabric loop. However, a third core, which is split and hinged to provide opposing semi-cylindrical sections, is placed around one of the inner cores so that it overlies the fabrics, the split core being of a larger diameter so that the looped end of the fabric is encased between the inner core and the outer core, the fabric projecting outwardly from between the split edges of the outer core. With this arrangement, the fabric may be readily wound on the outer split core. In order to decrease the chances of creasing the fabric as it is rolled, it is preferred to encapsulate the outer core in a material such as bubble pack, which increases the angle of wrap and hence reduces the possibility of a crease being formed as the rolling of the fabric on the outer core is initiated. In addition, the outer core may be provided with one or more enlargements, such as a plastic or similar extensions, fitted to one or both of the split edges of the outer core, such enlargements acting to further increase the angle of wrap and hence diminish the likelihood of creasing the fabric as it is wound on the outer core.

The winding of the fabric on the outer core is continued until the wound fabric contacts the core at the opposite end of the fabric, whereupon the latter core is secured to the composite inner and outer core to prevent the package from unrolling. Conventional ties or other attachment means may be used for this purpose.

DESCRIPTION OF THE PREFERRED EMBODIMENT

Figure 1:
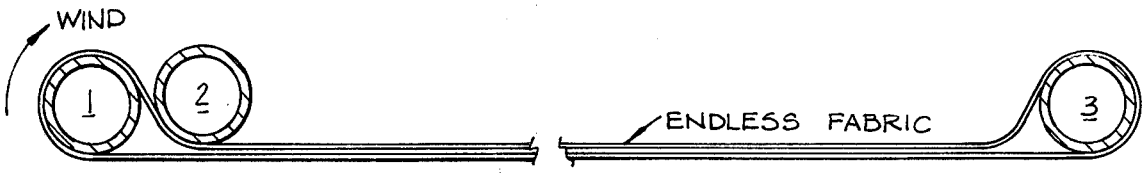
FIG 1 PRIOR ART
FIG. 1 is a diagrammatic side elevational view illustrating the initial placement of the cores in accordance with prior art practices.
Figure 2:
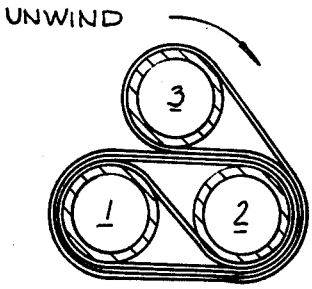
FIG 2 PRIOR ART
FIG. 2 is a diagrammatic side elevational view illustrating the wrapped package in accordance with prior art practices.
Figure 3:
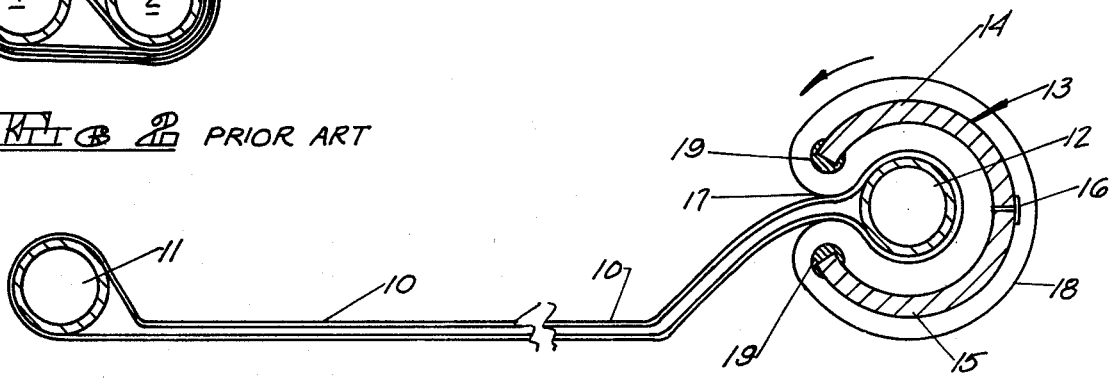
FIG. 3 is a diagrammatic side elevational view of the core arrangement of the present invention prior to rolling the fabric.

Referring first to FIG. 3 of the drawings, an endless fabric 10 is indicated in its unrolled condition, a conventional inner core 11 is inserted at one end of the fabric loop, and similarly a conventional inner core 12 is inserted at the opposite end of the loop. The cores 10 and 11 may be composed of any desired material, including plastic or metal, although preferably they will be formed from spirally wound paperboard stock in which the plies are laminated together to provide a wall thickness of about 0.5 inch. The diameter of the cores will vary depending upon the width of the fabric, and the length of the cores will be sufficient to extend beyond the opposite side edges of the fabric. During the winding process, the cores 11 and 12 normally will be mounted on stringing poles, usually formed from aluminum or steel, the stringing poles adding rigidity and minimizing deflection of the cores during the winding operation. Such stringing poles may be eliminated if the cores themselves are sufficiently rigid to permit them to be inserted directly in the chuck jaws.

In accordance with the invention, a third or outer core 13 is provided, the core 13 being of a size to effectively surround the inner core 12. The core 13 is of split construction, having opposing semi-cylindrical sections 14 and 15 hingedly connected together along one of their side edges by means of a hinge 16, thereby permitting the opposing semi-cylindrical sections to be opened and closed relative to each other. As in the case of the inner cores 11 and 12, the outer core may be formed of any desired material, although preferably it too will comprise a laminated paper core formed initially as a tube which is then severed lengthwise to define opposing halves. The nature of the hinge does not consitute a limitation on the invention, and various types of hinge materials may be utilized. In the case of paperboard tubes, the hinge may comprise a reinforced tape bridging the adjoining edges of the opposing sections. With this arrangement, the outer core 13 may be readily opened and fitted around the inner core 12 and the looped end of the fabric surrounding inner core 12, the fabric projecting outwardly from the longitudinal slot 17 defined by the remaining side edges of the sections 14 and 15.

Preferably, the outer core 13 will be encapsulated in a cushioning material 18, the cushioning material covering both the inner and outer surfaces of the outer core. Preferably, the cushioning material will comprise a packaging material known as bubble pack, which comprises sheets of a non-fibrous film laminated together to form a multiplicity of inflated compartments, although other forms of cushioning material may be employed. Preferably, the cushioning material will be first wrapped around the looped end of the fabric after insertion of the inner core 12, whereupon the outer core will be fitted over the cushioning material so as to surround the inner core and the looped end of the fabric, whereupon the remainder of the cushioning material will be wrapped around the outside of the outer core. Any suitable attachment means, such as adhesive or tape may be utilized to secure the cushioning material to the outer core.

In addition to serving as a cushioning medium for the wrapped fabric, the cushioning material also serves to increase the angle of wrap as the fabric is wound around the outer core. That is, as the fabric projects outwardly from the slot 17 in the outer core, the cushioning material effectively widens the slot so that their is no sharp crease or bend in the fabric as it is wrapped around the outer core. In addition, it is possible to further increase the angle of wrap by providing enlargements 19 along the free side edges of the semi-cylindrical sections 14 and 15. Such enlargements may be in the form of plastic extrusions fitted over the side edges of the sections, or the extrusions may be formed from other materials, the essential consideration being the provision of enlarged areas at the opposite sides of the slot 17 which will effectively increase the wrap angle. Such enlargements may be placed on either or both sides of the slot, depending upon the intended direction in which the fabric will be rolled. While the use of both cushioning material and enlargements along the opposite side edges of the slot 17 is preferred, it is to be understood that, depending upon the size and weight of the fabric being packaged, the cushioning material itself may provide the desired angle of wrap, in which event the enlargements may be eliminated; and conversely, situations may be encountered wherein the enlargements will provide the desired angle and the cushioning material may be eliminated.

Figure 4:
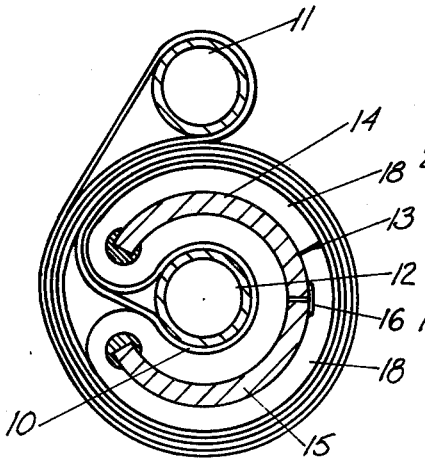
FIG. 4 is an enlarged side elevational view illustrating the packaged fabric following rolling.
Figure 5:
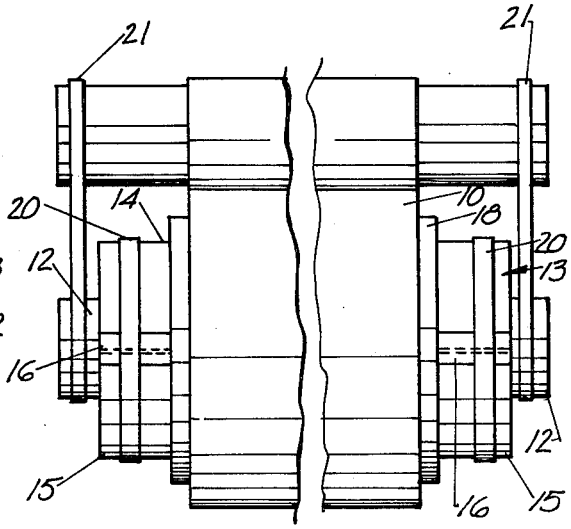
FIG. 5 is a diagrammatic plan view illustrating the inner and outer cores with the fabric rolled thereon.

Once the outer core has been positioned around the inner core and the looped end of the fabric, the outer core may be secured in place by means of suitable ties or banding 20, seen in FIG. 5, which may comprise metallic or plastic straps. Once the assembly has been completed, the inner and outer cores are rotated in unison, thereby causing the fabric to wind around the outer core, such winding continuing until the entire fabric has been wound on the outer core, thereby causing the remaining inner core 11 to contact the fabric roll, as illustrated in FIG. 4. Core 11, which preferably will be of a length equal to the length of inner core 12, will then be secured to inner core 12, as by means of additional banding 21, thereby preventing the package from unrolling. The fabric roll is now ready to be wrapped with a protective cover for storage or shipment.

As should now be evident, the instant invention provides improved means and methods for packaging endless fabrics in a manner which effectively eliminates the creasing of the fabric as an incident of the packaging operation. In addition to effectively eliminating creases, the packaging techniques of the present invention save packaging time in that the fabrics only need to be rolled once, not several times as is often the case utilizing the existing three core method of packaging.

Modifications may be made in the invention without departing from its spirit and purpose. A number of such modifications have already been set forth, and others will undoubtedly occur to the worker in the art upon reading this specification. For example, the ends of the cores 11 and 12 may be strengthened by providing end plugs which may be fitted into the ends of the cores.

The embodiments of the invention in which an exclusive property or privilege is claimed are defined as follows:

1. A package for endless papermaking fabrics, said package comprising an elongated endless fabric, a pair of inner cores inserted in said endless fabric at its opposite extremities, an outer core surrounding a first of said inner cores and the portion of the fabric extending around said inner core, said outer core comprising a pair of opposing semi-cylindrical sections, means hingedly connecting said sections together along a mating pair of their side edges, the opposite side edges of the sections being spaced apart to define a longitudinal slot through which the fabric projects, a layer of cushioning material interposed between the inner surface of said outer core and the fabric surrounding the first of said inner cores, the remainder of the fabric extending outwardly beyond said longitudinal slot being wound on said outer core, means extending along at least one edge of said slot acting to increase the angle of wrap of the fabric wound around said outer core, the other of said inner cores being juxtaposed to the rolled fabric, and means securing said cores together to form a package.

2. The package claimed in claim 1 wherein said cushioning material covers both the inner and outer surfaces of said outer core.

3. The package claimed in claim 2 wherein said cushioning material comprises a packing material having a multiplicity of cushion forming air chambers.

4. The package claimed in claim 1 wherein the means for increasing the angle of wrap of said fabric comprises an enlargement extending along at least one side edge of said longitudinal slot.

5. The package claimed in claim 1 wherein the means for increasing the angle of wrap of the fabric comprises cushioning means extending around at least one side edge of said longitudinal slot.

6. A method for packaging endless fabrics which comprises the steps of inserting a pair of inner core members in an elongated endless fabric at its opposite extremities, surrounding a first of said inner cores and the portion of the fabric extending around said first inner core with an outer core having a longitudinal slot therein, including the step of positioning said outer core so that the fabric extends through said longitudinal slot, jointly rotating said first inner core and said outer core to wrap the portion of the fabric extending between said longitudinal slot and the second of said inner cores around said outer core, including the step of juxtaposing said second inner core to the rolled fabric, and securing said cores together to form a package.

7. The method claimed in claim 6 including the step of interposing cushioning material between said fabric and said outer core.

8. The method claimed in claim 7 wherein said cushioning material covers both the inner and outer surfaces of said outer core.

9. The method claimed in claim 6 including the step of increasing the angle of wrap of the fabric relative to the outer core by enlarging at least one edge of said longitudinal slot.

10. The method claimed in claim 6 wherein said outer core comprises an opposing pair of semi-cylindrical sections hingedly connected together along a mating pair of their side edges, said sections being movable from closed to opened position and return, including the steps of opening the tube sections relative to each other, fitting the tube sections around the first inner core and closing the tube sections relative to each other, including the step of positioning the tube sections so that when they are closed, the opposite pair of side edges of said sections will define the longitudinal slot through which the fabric extends.

* * * * *